US009931551B2

(12) United States Patent
Mizutani

(10) Patent No.: US 9,931,551 B2
(45) Date of Patent: Apr. 3, 2018

(54) GOLF CLUB HEAD

(71) Applicant: DUNLOP SPORTS CO. LTD., Kobe-shi, Hyogo (JP)

(72) Inventor: Naruhiro Mizutani, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/385,426

(22) Filed: Dec. 20, 2016

(65) Prior Publication Data

US 2017/0173421 A1 Jun. 22, 2017

(30) Foreign Application Priority Data

Dec. 21, 2015 (JP) ..... 2015-249134

(51) Int. Cl.
*A63B 53/04* (2015.01)
*A63B 53/06* (2015.01)

(52) U.S. Cl.
CPC ..... *A63B 53/06* (2013.01); *A63B 53/0466* (2013.01); *A63B 2053/0433* (2013.01); *A63B 2053/0437* (2013.01); *A63B 2053/0491* (2013.01)

(58) Field of Classification Search
CPC ..... A63B 53/06; A63B 53/0466; A63B 2053/0433; A63B 2053/0437; A63B 2053/0491; F16B 43/00
USPC ..... 473/324–350, 287–292, 256; 411/166, 411/531
See application file for complete search history.

(56) References Cited

U.S. PATENT DOCUMENTS 5,439,223 A * 8/1995 Kobayashi ..... A63B 53/04 473/334
6,089,994 A * 7/2000 Sun ..... A63B 53/04 473/338
6,773,360 B2 * 8/2004 Willett ..... A63B 53/0466 473/334
7,153,220 B2 * 12/2006 Lo ..... A63B 53/0466 473/335
7,462,110 B2 * 12/2008 Yamamoto ..... A63B 53/0466 473/334
7,572,194 B2 * 8/2009 Yamamoto ..... A63B 53/0466 473/334
7,628,711 B2 * 12/2009 Akinori ..... A63B 53/0466 411/337
7,637,823 B2 * 12/2009 Shimazaki ..... A63B 53/0466 473/332

(Continued)

*Primary Examiner* — Sebastiano Passaniti
(74) *Attorney, Agent, or Firm* — Birch, Stewart, Kolasch & Birch, LLP

(57) ABSTRACT

The golf club head includes a crown portion, a face portion, a sole portion, at least one recessed portion formed in one of the crown portion and the sole portion, at least one weight member configured to be attached to the recessed portion. The weight member has an upper surface, a lower surface and a side surface. The recessed portion is provided with a bottom surface correspond to the lower surface of the weight member, a first side wall surface that is continuous with the bottom surface and corresponds to the side surface of the weight member, and a second side wall surface that is continuous with the first side wall surface and constitutes an opening periphery of the recessed portion, and the second side wall surface is formed along the first side wall surface at a larger outer diameter than the first side wall surface.

4 Claims, 16 Drawing Sheets

(56) References Cited

U.S. PATENT DOCUMENTS

| | | | | |
|---|---|---|---|---|
| 7,871,339 | B2 * | 1/2011 | Sanchez | A63B 53/0466 473/335 |
| 7,922,433 | B2 * | 4/2011 | Ricciardo | F16B 39/10 411/119 |
| 8,262,506 | B2 * | 9/2012 | Watson | A63B 53/0466 473/334 |
| 8,414,422 | B2 * | 4/2013 | Peralta | A63B 53/0466 473/334 |
| 8,517,851 | B2 * | 8/2013 | Cackett | A63B 53/0466 473/242 |
| 8,684,863 | B2 | 4/2014 | Bezilla et al. | |
| 9,168,439 | B2 * | 10/2015 | Motokawa | A63B 53/06 |
| 9,265,994 | B2 * | 2/2016 | Mizutani | A63B 53/0466 |
| 9,433,836 | B2 * | 9/2016 | Breier | A63B 53/0466 |
| 2001/0022926 | A1 * | 9/2001 | Kitayama | F16B 43/001 411/531 |
| 2013/0029775 | A1 * | 1/2013 | Demkowski | A63B 53/00 473/291 |
| 2014/0248975 | A1 * | 9/2014 | Abbott | A63B 53/06 473/332 |
| 2016/0361613 | A1 * | 12/2016 | Abe | A63B 53/06 |

* cited by examiner

GOLF CLUB HEAD

CROSS REFERENCE TO RELATED APPLICATION

This application claims a priority to Japanese Patent Application No. 2015-249134 filed on Dec. 21, 2015, which is hereby incorporated by reference in its entirety.

FIELD OF INVENTION

The present invention relates to a golf club head.

BACKGROUND OF THE INVENTION

U.S. Pat. No. 8,684,863 proposes a golf club head that has a recessed portion formed in a sole portion and that allows a weight to be detachably attached to this recessed portion. With this golf club head, the weight and the center of gravity of the head can be changed by attaching a weight. For example, in U.S. Pat. No. 8,684,863, a weight member having a polygonal shape in plan view is fitted into a recessed portion that similarly has a polygonal shape in plan view, and the weight member is fixed in the recessed portion by a fixing member such as a screw that passes through the weight member.

SUMMARY OF INVENTION

A first golf club head according to the present invention includes a crown portion, a face portion, a sole portion, at least one recessed portion formed in one of the crown portion and the sole portion, at least one weight member configured to be attached to the recessed portion, and a fixing member for fixing the weight member to the recessed portion. The weight member has an upper surface, a lower surface and a side surface, the upper surface and the lower surface being formed to have a polygonal shape in plan view, and is provided with a through hole for passing the fixing member through, the recessed portion is provided with a bottom surface formed to have a polygonal shape in plan view so as to correspond to the lower surface of the weight member, a first side wall surface that is continuous with the bottom surface and corresponds to the side surface of the weight member, and a second side wall surface that is continuous with the first side wall surface and constitutes an opening periphery of the recessed portion, a fixing hole in which the fixing member is to be fixed is formed in the bottom surface, and the second side wall surface is formed along the first side wall surface at a larger outer diameter than the first side wall surface.

A second golf club head according to the present invention includes a crown portion, a face portion, a sole portion, at least one recessed portion formed in one of the crown portion and the sole portion, at least one weight member configured to be attached to the recessed portion, and a fixing member for fixing the weight member to the recessed portion. The weight member is provided with a main body portion having an upper surface, a lower surface and a side surface, the upper surface and the lower surface being formed to have a polygonal shape in plan view, and a projecting portion projecting from the lower surface of the main body portion, and a through hole for the fixing member to pass through is provided in the main body portion and the projecting portion, the projecting portion has a lower surface and a side surface that is continuous with the lower surface and connected to the lower surface of the main body portion, the recessed portion is provided with a bottom surface and a side wall surface that is continuous with the bottom surface, a recessed receiving portion into which the projecting portion of the weight member fits is formed in the bottom surface of the recessed portion, the receiving portion is provided with a bottom surface in which a fixing hole in which the fixing member is to be fixed is formed, and a side wall surface that is continuous with the bottom surface, and the golf club head is configured such that a gap is formed between the side surface of the main body portion of the weight member and the side wall surface of the recessed portion, when the projecting portion of the weight member rotates within the receiving portion centered on the fixing hole and the side surface of the projecting portion abuts the side wall surface of the receiving portion.

A third golf club head according to the present invention includes a crown portion, a face portion, a sole portion, at least one recessed portion formed in one of the crown portion and the sole portion, at least one weight member configured to be attached to the recessed portion, and a fixing member for fixing the weight member to the recessed portion. The weight member has an upper surface, a lower surface and a side surface, a recessed receiving portion being formed in the lower surface, and is provided with a through hole that passes through the lower surface and is for the fixing member to pass through, and the recessed portion is provided with a bottom surface formed to have a polygonal shape in plan view so as to correspond to the lower surface of the weight member, and a side wall surface that is continuous with the bottom surface, a projecting portion that fits into the receiving portion is formed in the bottom surface of the recessed portion, the projecting portion has an upper surface and a side surface that is continuous with the upper surface and connected to the bottom surface of the recessed portion, the receiving portion is provided with a side wall surface that corresponds to the side surface of the projecting portion, a fixing hole in which the fixing member is to be fixed is formed in the upper surface of the projecting portion, and the golf club head is configured such that a gap is formed between the side surface of the weight member and the side wall surface of the recessed portion, when the weight member rotates within the recessed portion centered on the fixing hole and the side surface of the projecting portion abuts the side wall surface of the receiving portion.

In the first golf club head, a configuration can be adopted in which the second side wall surface has a similar shape to the first side wall surface in plan view, and is formed in a position, centered on the fixing hole, rotated so as to incline from the first side wall surface in a manner that does not overlap with the first side wall surface.

In the second golf club head, a configuration can be adopted in which the side surface of the projecting portion is formed to have a rectangular shape in plan view, and the side wall surface of the receiving portion is formed to have a rectangular shape in plan view, so as to correspond to the side surface of the projecting portion.

In the third golf club head, a configuration can be adopted in which the side surface of the projecting portion is formed to have a rectangular shape in plan view, and the side wall surface of the receiving portion is formed to have a rectangular shape in plan view, so as to correspond to the side surface of the projecting portion.

In the first golf club head, a configuration can be adopted in which the first side wall surface is disposed so as to be inscribed in the second side wall surface in plan view.

In each of the above golf club heads, a configuration can be adopted in which the fixing member is rotatably supported within the through hole of the weight member.

With a golf club head according to an one aspect of embodiment, degradation in appearance can be prevented, even if the rotation position relative to the recessed portion of the weight member is displaced.

DETAILED DESCRIPTION OF THE PREFERRED EMBODIMENTS

Figure 29:
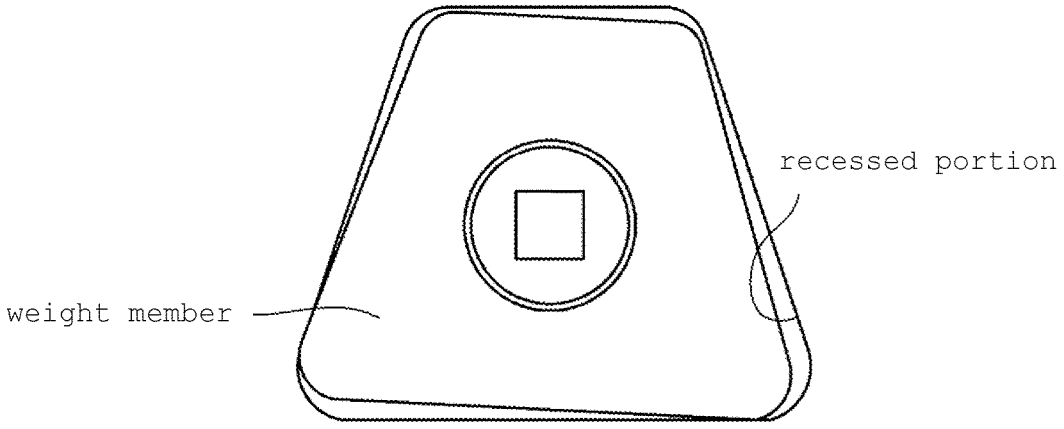
FIG. 29 is a plan view when a conventional weight member is attached to a recessed portion.

There is the following problem with a golf club head such as described in U.S. Pat. No. 8,684,863. That is, in the case of fixing the weight member in the recessed portion, the fixing member is screwed into the recessed portion, although, at this time, the weight member sometimes also rotates together with the rotation of the fixing member. The weight member has a polygonal shape in plan view and clearance is provided between the side surface of the weight member and the side wall surface of the recessed portion, and thus, for example, as shown in FIG. 29, the rotation position of the weight member is displaced and the weight member is fixed in a state where a part of the side surface of the weight member abuts against the side wall surface of the recessed portion. When such a state occurs, the gap between the side surface of the weight member and the side wall surface of the recessed portion is no longer constant. That is, there will be places where the side surface of the weight member and the side wall surface of the recessed portion abut and also places where a gap is formed between the side surface of the weight member and the side wall surface of the recessed portion, making it readily noticeable that the fixed position of the weight member is displaced. As a result, there is a problem in that appearance is degraded.

The embodiments are made in order to solve the above problem, and an object is to provide a golf club head that helps to prevent degradation in appearance, even if the rotation position relative to the recessed portion of the weight member is displaced.

First to third embodiments of a golf club head according to the present invention will be described below, with reference to the drawings.

1. Outline of Golf Club Head

Figure 1:
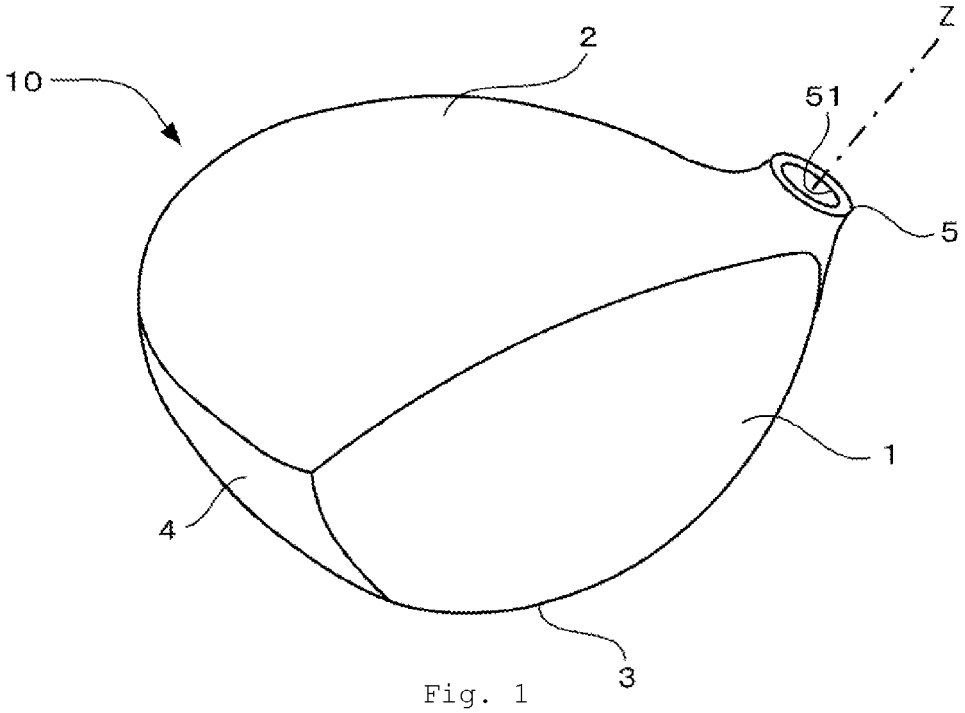
FIG. 1 is a perspective view of a reference state in first to third embodiments of a golf club head according to the present invention.
Figure 2:
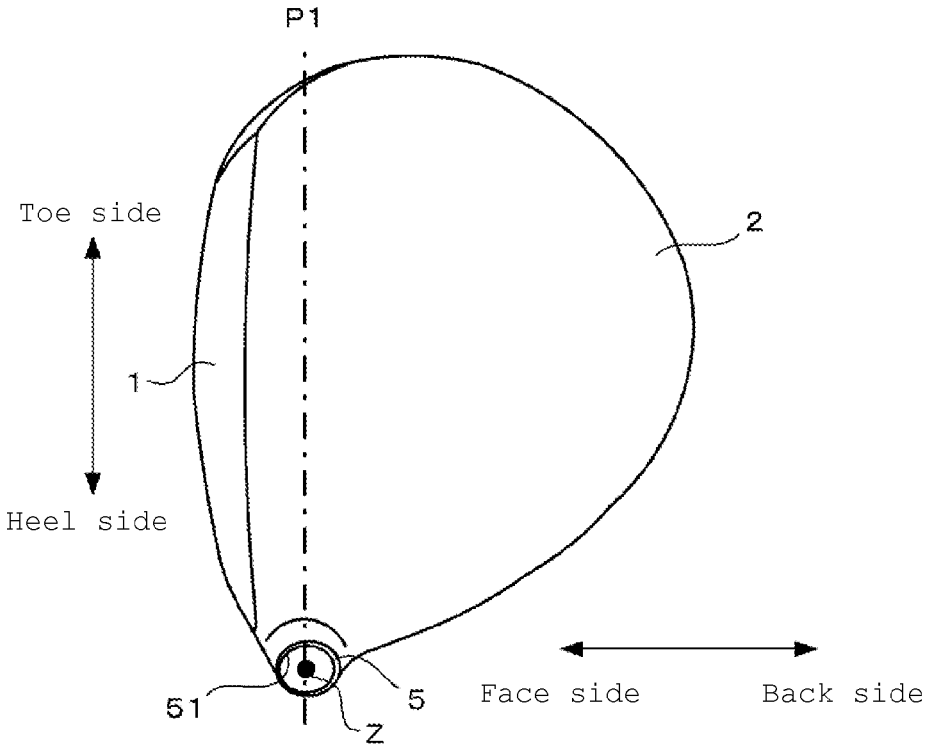
FIG. 2 is a plan view of FIG. 1.
Figure 3:
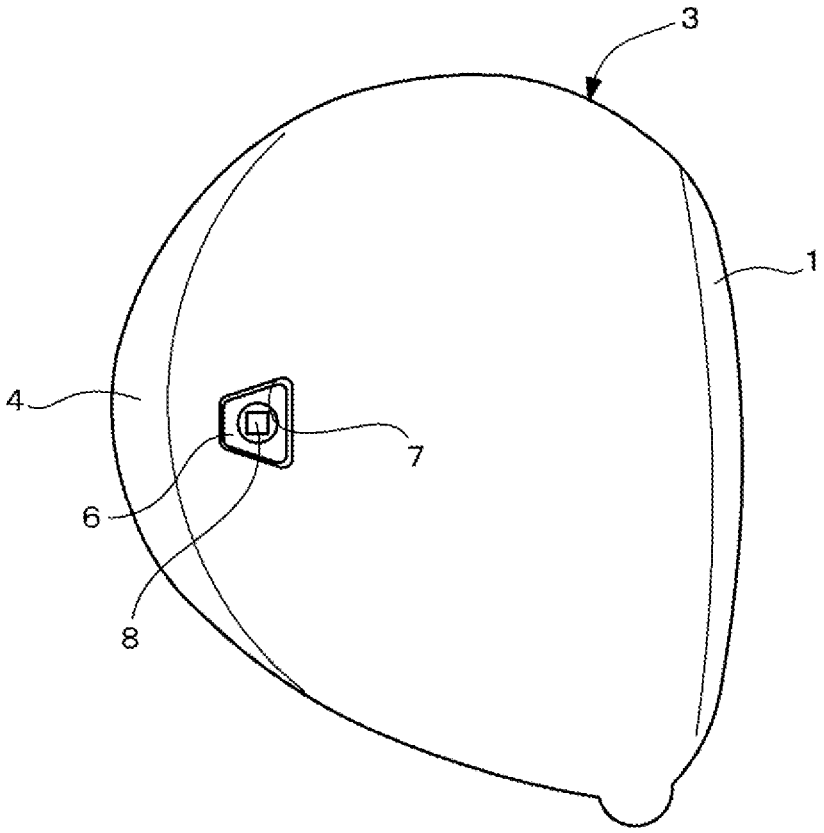
FIG. 3 is a bottom view of FIG. 1 and a partial cross-sectional view.

The first to third embodiments of the golf club head according to the present invention have a common configuration except for a weight member that adjusts the center of gravity and a recessed portion that houses the weight member. In view of this, configuration other than the weight member and the recessed portion will be described first with reference to FIGS. 1 to 3, and the weight member and the recessed portion will be discussed later. FIG. 1 is a perspective view of a reference state of a golf club head according to the first to third embodiments, FIG. 2 is a plan view of FIG. 1, and FIG. 3 is a bottom view of FIG. 1.

As shown in FIG. 1, this golf club head (hereinafter, may simply be referred to as the "head") is a hollow structure having an internal space, and a wall surface is formed by a face portion 1, a crown portion 2, a sole portion 3, a side portion 4, and a hosel portion 5.

The face portion 1 has a face surface, which is the surface that hits the ball, and the crown portion 2 is adjacent to the face portion 1 and constitutes the upper surface of the head. The sole portion 3 constitutes the bottom surface of the head, and is adjacent to the face portion 1 and the side portion 4. As shown in FIG. 3, a recessed portion 7 is formed in the sole portion 3, and a weight member 6 is attached to this recessed portion 7 by a fixing member 8. Also, the side portion 4 is a region between the crown portion 2 and the sole portion 3, and extends from the toe side of the face portion 1 to the heel side of the face portion 1 around the back side of the head. Furthermore, the hosel portion 5 is a region that is provided adjacent to the heel side of the crown portion 2, and has an insertion hole 51 into which the shaft (illustration omitted) of the golf club is inserted. A center axis Z of this insertion hole 51 coincides with the axis of the shaft.

Here, the abovementioned reference state will be described. First, as shown in FIGS. 1 and 2, a state in which the center axis Z is included in a perpendicular plan P1 relative to the ground (horizontal plan), and the head is placed on the ground at a predetermined lie angle and real loft angle is prescribed as the reference state. The plan P1 is referred to as a reference perpendicular plan. Also, as shown in FIG. 2, the direction of the line of intersection of the reference perpendicular plan P1 and the ground will be referred to as the toe-heel direction, and the direction that is perpendicular to this toe-heel direction and parallel to the ground will be referred to as the face-back direction. Note that with the golf club set according to the present embodiment, the loft angle increases as the number of the club increases, similarly to a typical golf club set.

In the present embodiment, the boundary between the sole portion 3 and the face portion 1 and between the sole portion 3 and the side portion 4 can be defined as follows. That is, in the case where a ridgeline is formed between the sole portion 3 and the face portion 1 and between the sole portion 3 and the side portion 4, this ridgeline will be the boundary. Also, the golf club head according to the present embodiment has the side portion 4, but in the case where, for example, the side portion 4 is not provided and the sole portion 3 is directly connected to the crown portion 2, the ridgeline between the sole portion 3 and the crown portion 2 will be the boundary between the two portions. Also, in the case where a clear ridgeline is not formed, the profile seen when the head is placed in the reference state and viewed from directly above the center of gravity of the head will be the boundary. Note that in consideration of the case where the side portion cannot be clearly judged as described above, the "sole portion" according to the present invention is deemed to include the side portion.

The volume of this golf club head is, for example, preferably 300 $cm^3$ or greater, more preferably 400 $cm^3$ or greater, and particularly preferably 420 $cm^3$ or greater. A head having such a volume helps to make the golfer feel more confident when addressing the ball, and also helps to increase the sweet area and the moment of inertia. Note that the upper limit of the head volume is not particularly determined, although 500 $cm^3$ or less, for example, is desirable in terms of actual use, and 470 $cm^3$ or less is desirable in the case of complying with the rules and regulations of the R&A and the USGA.

Also, the head can, for example, be formed with a titanium alloy (Ti-6Al-4V) having a specific gravity substantially around 4.4 to 4.5. Also, apart from a titanium alloy, the head can also be formed using one or a plurality of materials selected from a group including stainless steel, maraging steel, an aluminum alloy, a magnesium alloy and an amorphous alloy. Such a golf club head can be produced with various methods, and can, for example, be manufactured by casting such as well-known lost-wax precision casting.

Note that the head according to the present embodiment is constituted by combining other portions with a head main body having at least the sole portion 3. For example, the head can be constituted by constituting only the face portion 1 with a separate member and attaching the face portion 1 to the head main body, or the head can also be constituted by forming a head main body provided with an opening in the crown portion 2 or the side portion 4 and closing this opening with a separate member. Also, a cup face structure provided with a peripheral portion around the circumference of the face portion 1 can also employed.

2. Weight Member and Recessed Portion

The weight member and recessed portion according to the first to third embodiments will be described below.

Hereinafter, for convenience, description will be given based on the up-down direction in the diagrams, but this direction is not necessarily intended to limit the invention.

2.1 First Embodiment

2.1.1 Configurations of Weight Member and Recessed Portion

Figure 4:
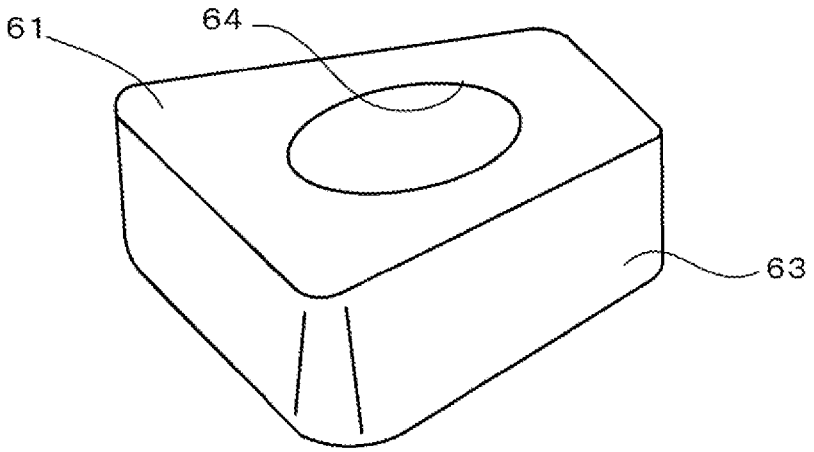
FIG. 4 is a perspective view of a weight member according to the first embodiment.
Figure 5:
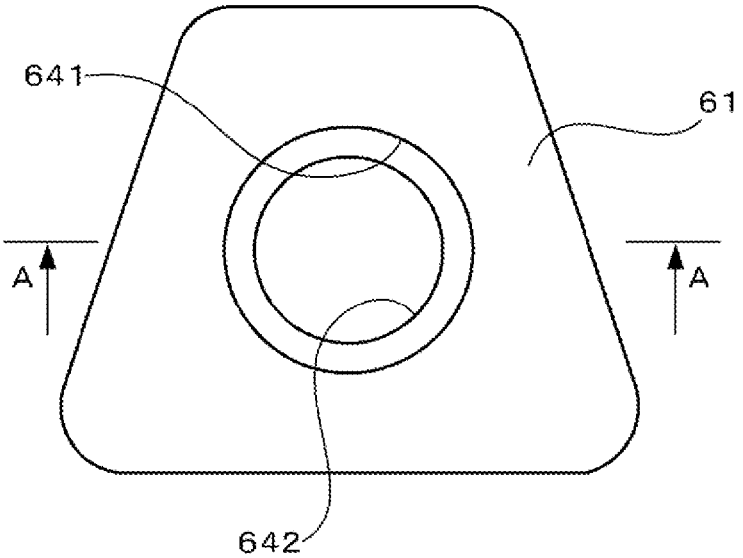
FIG. 5 is a plan view of the weight member of FIG. 4.
Figure 6:
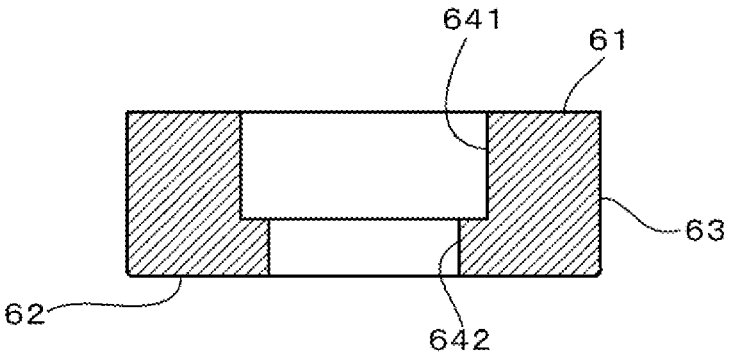
FIG. 6 is a cross-sectional view along a line A-A in FIG. 5.

FIG. 4 is a perspective view of the weight member according to the first embodiment, FIG. 5 is a plan view of the weight member of FIG. 4, and FIG. 6 is a cross-sectional view along a line A-A in FIG. 5. As shown in FIGS. 4 to 6, the weight member 6 according to the first embodiment has an upper surface 61 and a lower surface 62 that have a trapezoidal shape in plan view, and these surfaces are connected by a side surface 63. A through hole 64 passing through the upper surface 61 and the lower surface 62 is formed in this weight member 6, and the fixing member 8 is configured to pass through this through hole 64. The through hole 64 is provided with a large diameter portion 641 that has a circular shape in plan view and is open in the upper surface 61, and a small diameter portion 642 that has a circular shape in plan view and is open from the bottom surface of this large diameter portion 641 to the lower surface 62. A head portion 81 of the fixing member 8, which will be discussed later, is fitted into the large diameter portion 641, and a shaft portion 82 of the fixing member 8 passes through the small diameter portion 642, which has a smaller diameter than the large diameter portion 641.

Figure 7A:
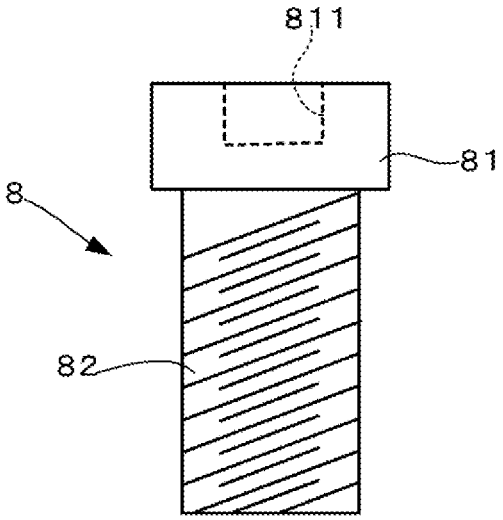
FIG. 7A is a side view and FIG. 7B is a plan view of a fixing member.
Figure 7B:
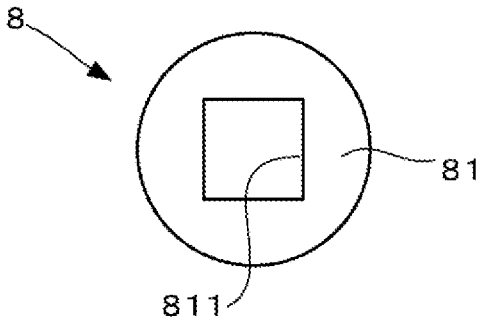

As shown in FIG. 7, the fixing member 8 is provided with a columnar head portion 81 and a shaft portion 82 extending from the bottom surface of this head portion 81. A recessed engaging portion 811 having a rectangular shape in plan view and into which a wrench (illustration omitted) is to be fitted is formed in the upper surface of the head portion 81. On the other hand, the shaft portion 82 has a smaller diameter than the head portion 81, and a male thread is formed in the surface thereof.

Figure 8:
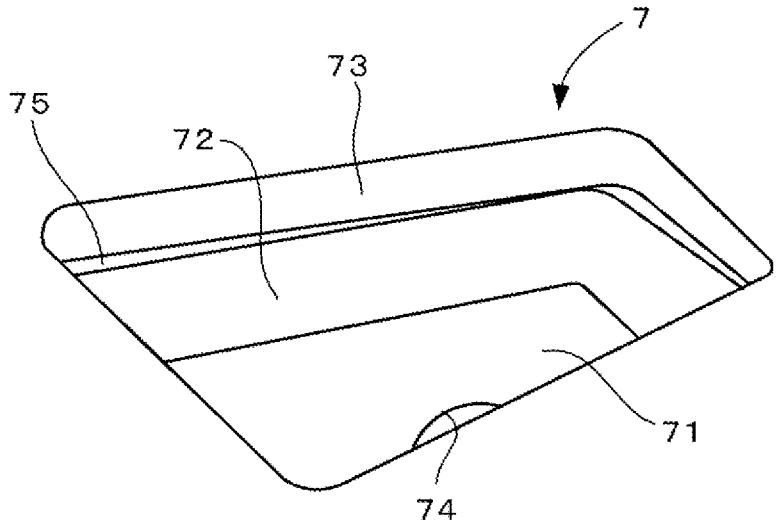
FIG. 8 is a perspective view of a recessed portion according to the first embodiment.
Figure 9:
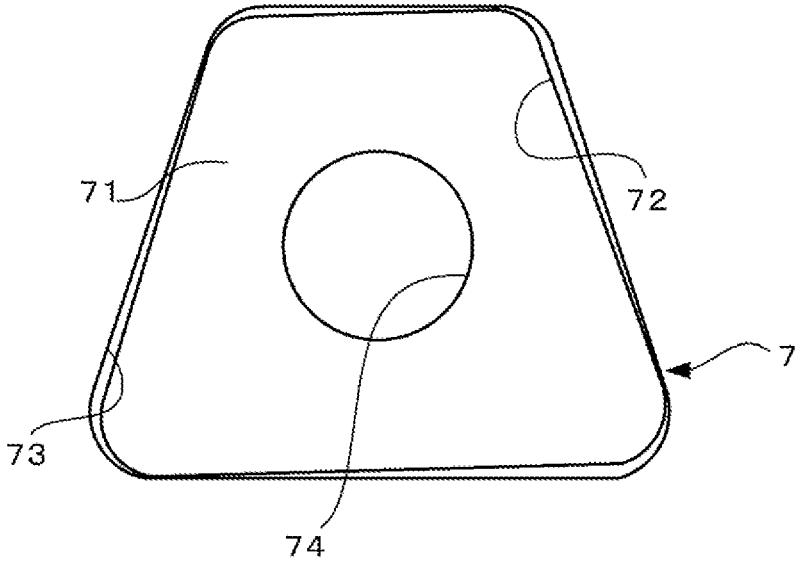
FIG. 9 is a plan view of FIG. 8.
Figure 10:
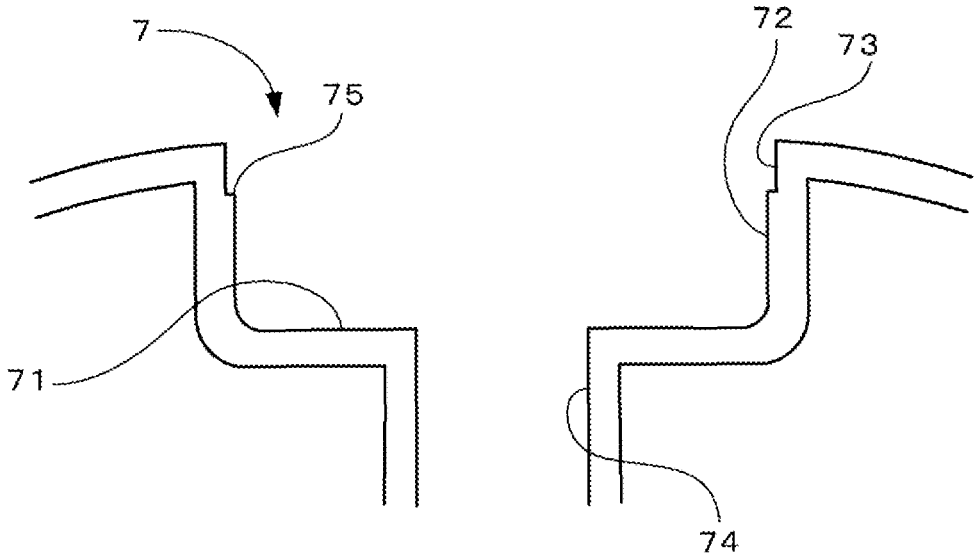
FIG. 10 is a cross-sectional view of the recessed portion.

Next, the recessed portion 7 formed in the sole portion 3 will be described, with reference to FIGS. 8 to 10. FIG. 8 is a perspective view of the recessed portion, FIG. 9 is a plan view of the recessed portion, and FIG. 10 is a cross-sectional view of the recessed portion. As shown in FIGS. 8 to 10, the recessed portion 7 is provided with a bottom surface 71 formed in a trapezoidal shape in plan view so as to correspond to the weight member 6, a first side wall surface 72 extending from a periphery of this bottom surface 71, and a second side wall surface 73 extending from the upper end of the first side wall surface 72 and forming the opening of the recessed portion 7. A fixing hole 74 into which the shaft portion 82 of the fixing member 8 is to be screwed is formed in the bottom surface 71, and a female thread is formed in the inner wall surface of this fixing hole 74.

Figure 11:
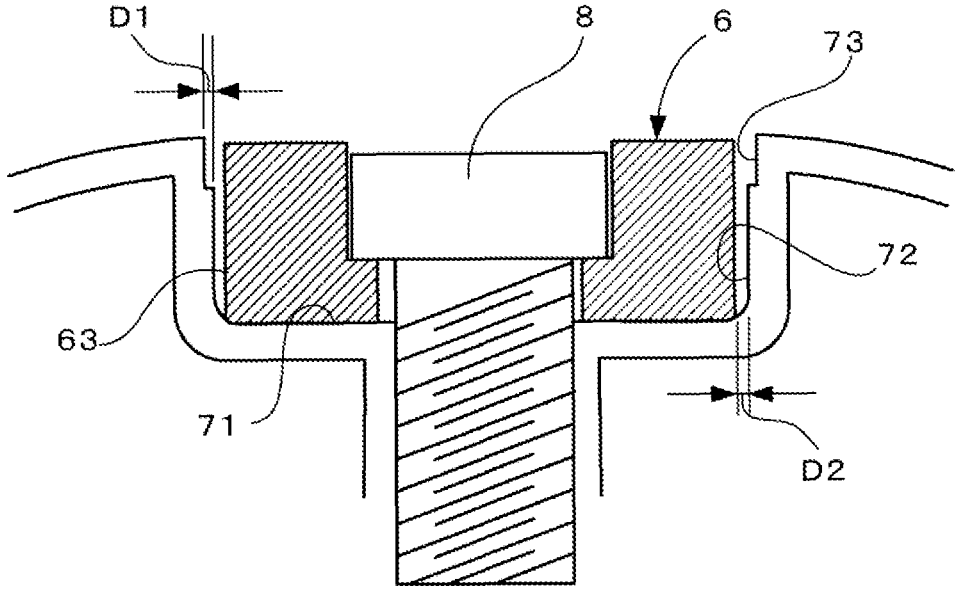
FIG. 11 is a cross-sectional view when the weight member is attached to the recessed portion.

The first side wall surface 72 is formed so as to correspond to the side surface 63 of the weight member 6, and the second side wall surface 73 is formed so as to have a similar shape to the first side wall surface 72 in plan view with a larger outer diameter than the first side wall surface 72. Accordingly, a step 75 is formed between the upper end of the first side wall surface 72 and the lower end of the second side wall surface 73. Also, the height of the second side wall surface 73 from the step 75 is generally one third of the height of the first side wall surface 72 from the bottom surface 71. Furthermore, as shown in FIG. 9, the first and second side wall surfaces 72 and 73 are disposed concentrically centered on the fixing hole 74, with the second side wall surface 73 being disposed in a position, centered on the fixing hole 74, rotated slightly clockwise (approx. 2 degrees) relative to the first side wall surface 72. In plan view, however, both side wall surfaces 72 and 73 are in a positional relationship where the first side wall surface 72 is generally inscribed in the second side wall surface 73, so as to not overlap. A distance D1 between the first side wall surface 72 and the second side wall surface 73 is preferably set to 0.2 to 1.5 mm, for example, in the case where the weight member 6 is disposed such that the distance between both surfaces is the same in all locations (see FIG. 11).

2.1.2 Attachment of Weight Member

Next, attachment of the weight member 6 will be described. When the weight member 6 is fitted into the recessed portion 7, the shaft portion 82 of the fixing member 8 is inserted into the through hole 64. Then, when the shaft portion 82 is screwed into the fixing hole 74 of the recessed portion 7, the lower surface of the weight member 6 is pressed against the bottom surface 71 of the recessed portion 7, and the weight member 6 is fixed in the recessed portion 7. At this time, the weight member 6 also rotates with the rotation caused by the screwing of the fixing member 8. The side surface 63 of the weight member 6 thereby abuts the first side wall surface 72 and is fixed. Note that a distance D2 between the side surface 63 of the weight member 6 and the first side wall surface 72 is preferably 0.2 to 1.0 mm, in the case where the weight member 6 is disposed such that the distance between both surfaces is the same in all locations (see FIG. 11).

2.1.3 Features

Figure 12A:
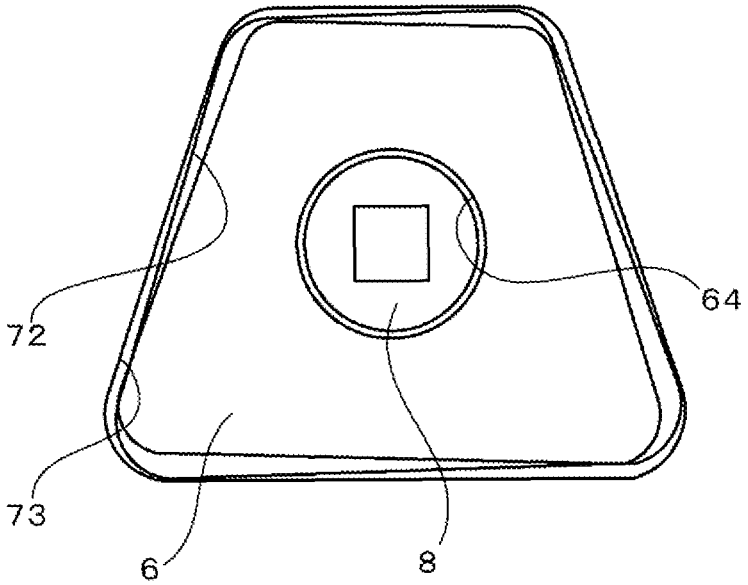
FIGS. 12A and 12B are plan views when the weight member is attached to the recessed portion, with FIG. 12A illustrating a first side wall surface, and FIG. 12B omitting the first side wall surface.
Figure 12B:
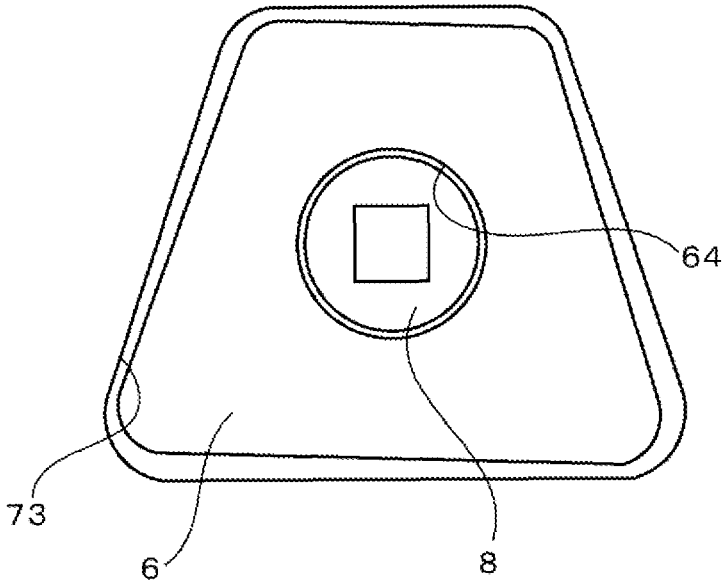

As described above, according to the present embodiment, the following effect can be obtained. This point will be described with reference to FIGS. 12A and 12B. FIG. 12A is a plan view when the weight member is attached to the recessed portion, and FIG. 12B omits the first side wall surface for convenience of description. As shown in these diagrams, even if the weight member 6 is attached to the recessed portion 7 and the rotation of the fixing member 8 results in the weight member 6 also rotating and abutting the first side wall surface 72, a gap still remains between the side surface 63 of the weight member 6 and the second side wall surface 73. Accordingly, even if the rotation position of the weight member is displaced, this displacement is no longer readily noticeable, due to the gap between the side surface 63 of the weight member 6 and the second side wall surface 73, and, as a result, degradation in appearance can be prevented.

Figure 13:
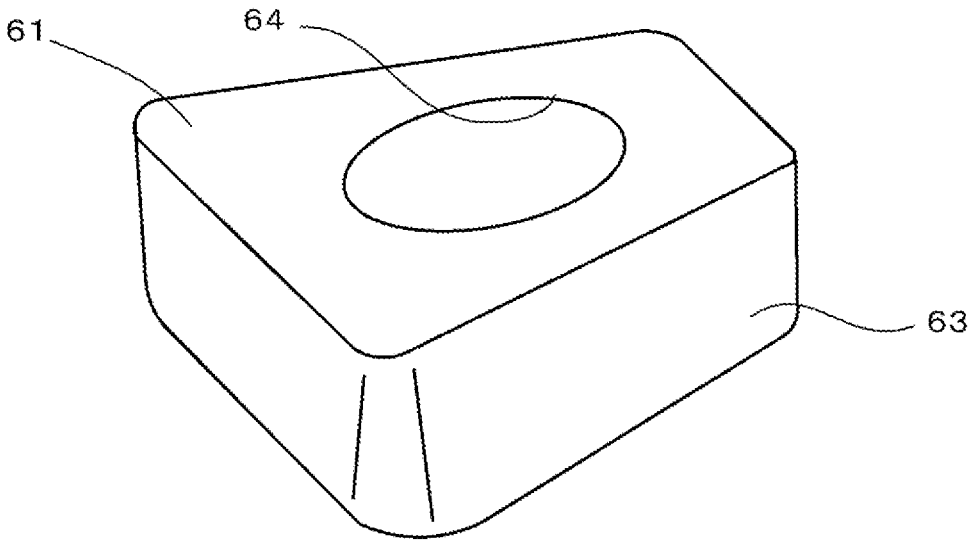
FIG. 13 is a perspective view seen from an upper surface side of the weight member according to a second embodiment.
Figure 14:
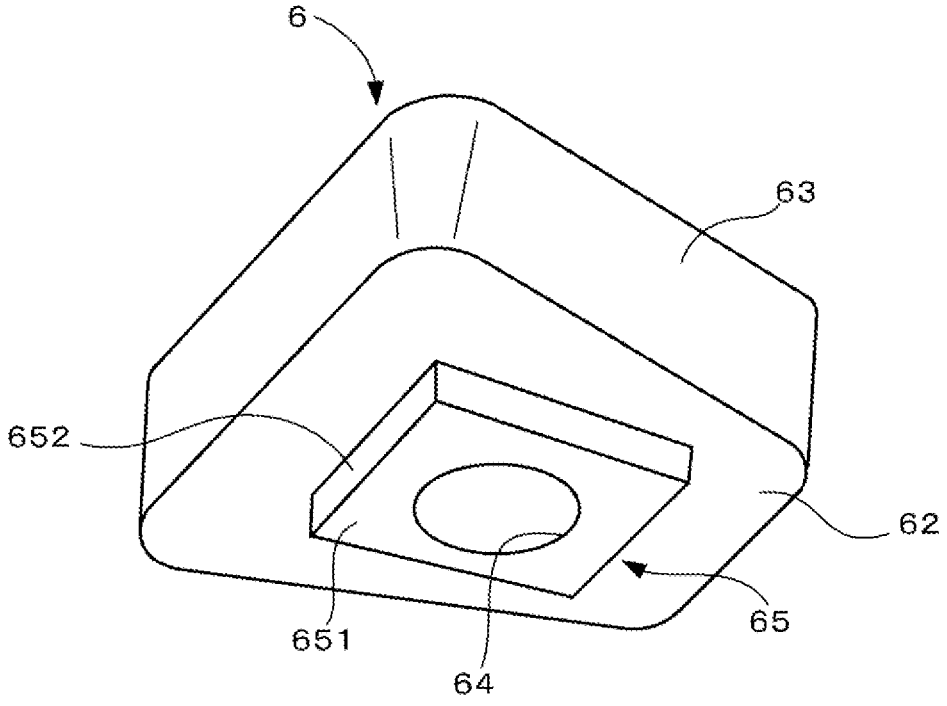
FIG. 14 is a perspective view seen from a lower surface side of the weight member of FIG. 13.
Figure 15:
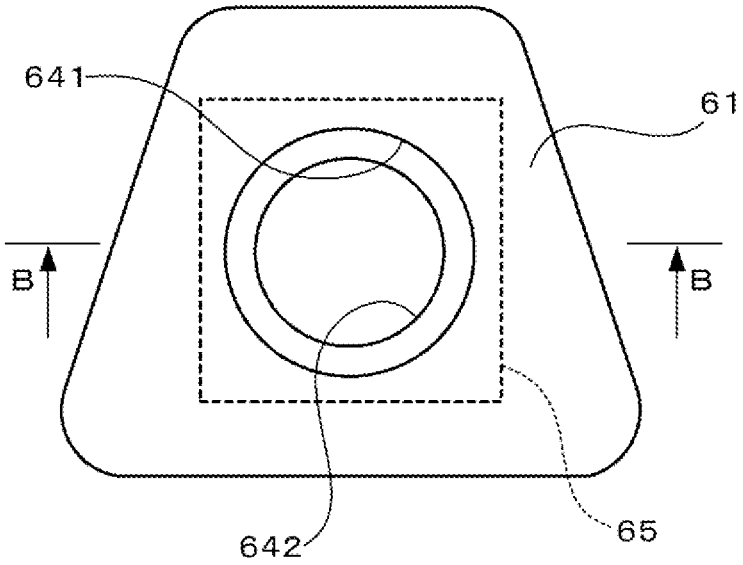
FIG. 15 is a plan view of FIG. 13.
Figure 16:
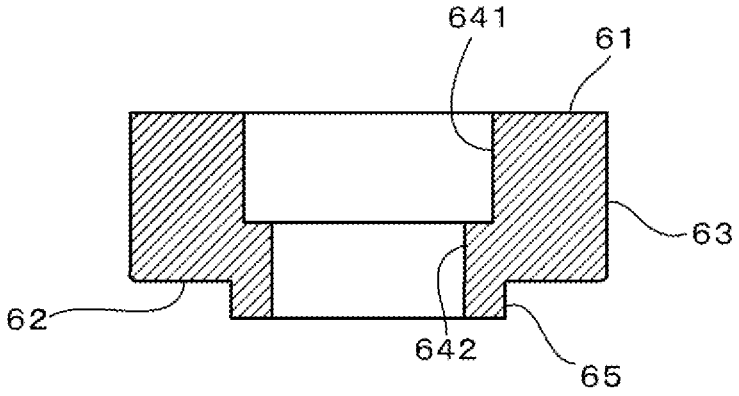
FIG. 16 is a cross-sectional view along a line B-B in FIG. 15.

2.2 Second Embodiment 2.2.1 Configurations of Weight Member and Recessed Portion FIG. 13 is a perspective view seen from the upper surface side of the weight member according to a second embodiment, FIG. 14 is a perspective view seen from the lower surface side of the weight member of FIG. 13, FIG. 15 is a plan view of FIG. 13, and FIG. 16 is cross-sectional view along a line B-B of FIG. 15. As shown in FIGS. 13 to 16, the weight member 6 according to the second embodiment has a generally similar form to the weight member of the first embodiment, but differs in that a projecting portion 65 is provided on the lower surface. The configuration of the bottom surface of the recessed portion also differs from the first embodiment. This projecting portion 65 and the bottom surface of the recessed portion 7 will be described in detail below, with the same reference signs being given to configuration that is the same as the first embodiment and description thereof being omitted.

As shown in FIGS. 13 to 16, the projecting portion 65 is formed in a rectangular parallelepiped shape provided with a bottom surface 651 that is rectangular in plan view, and a side surface 652 that extends from a periphery of this bottom surface 651 and is connected to the lower surface 62 of the weight member 6. The through hole 64 of the weight member 6 is smaller than the bottom surface 651 of the projecting portion 65, and passes through in a vicinity of the center of the projecting portion 65. Note that, in the present embodiment, portions of the weight member 6 other than the projecting portion 65 constitute a main body portion of the present invention.

Figure 17:
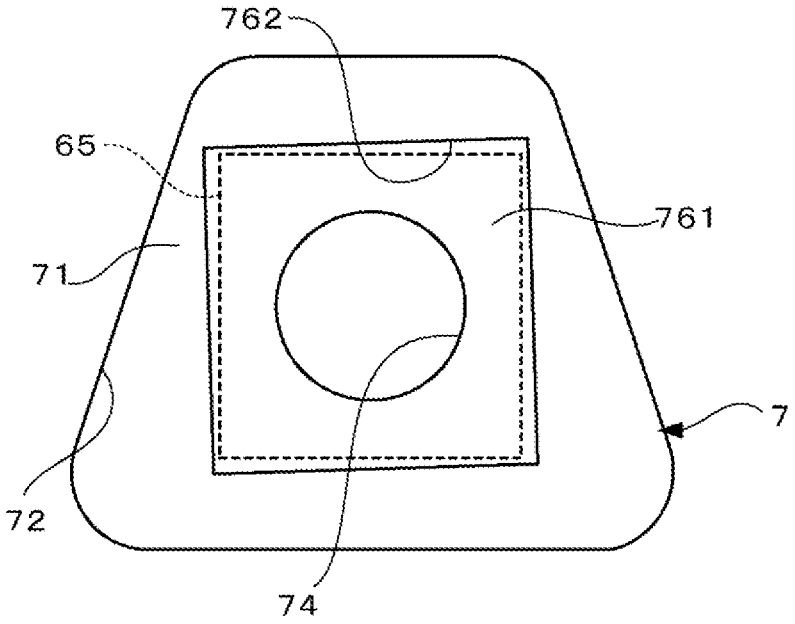
FIG. 17 is a plan view of the recessed portion according to the second embodiment.
Figure 18:
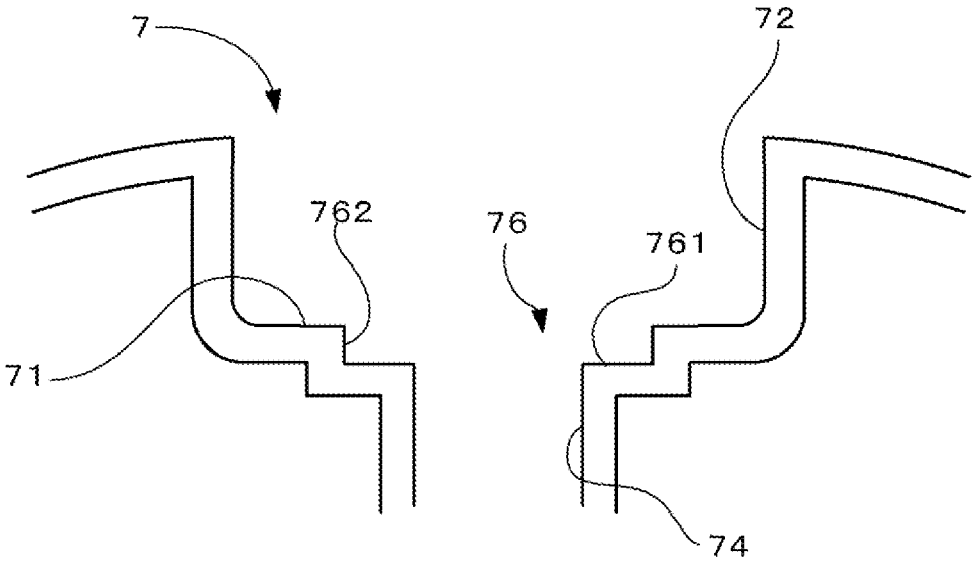
FIG. 18 is a cross-sectional view of FIG. 17.

Next, the recessed portion will be described with reference to FIGS. 17 and 18. FIG. 17 is a plan view of the recessed portion, and FIG. 18 is a cross-sectional view of FIG. 17. In the present embodiment, a receiving portion 76 into which the projecting portion 65 of the weight member 6 fits is formed in the bottom surface 71 of the recessed portion 7. The receiving portion 76 has a bottom surface 761 that has a rectangular shape in plan view and a side wall surface 762 that extends from this bottom surface 761 and is connected to the bottom surface 71 of the recessed portion 7. Also, the fixing hole 74 into which the shaft portion 82 of the fixing member 8 is screwed is formed in the bottom surface 761 of this receiving portion 76.

Also, as shown in FIG. 17, this receiving portion 76 corresponds to the projecting portion 65 of the weight member 6, and when the side surface 63 of the weight member 6 is disposed so as to be at the same distance from the first side wall surface 72 in all locations, the receiving portion 76 is disposed in a position, centered on the fixing hole 74, rotated slightly counterclockwise from the projecting portion 65. Note that this rotation angle needs to be smaller than the rotation angle at which the side surface 63 of the weight member 6 abuts the first side wall surface 72, from an attachment position at which the distance between the side surface 63 of the weight member 6 and the first side wall surface 72 is the same in all locations.

2.2.2 Attachment of Weight Member

Figure 19:
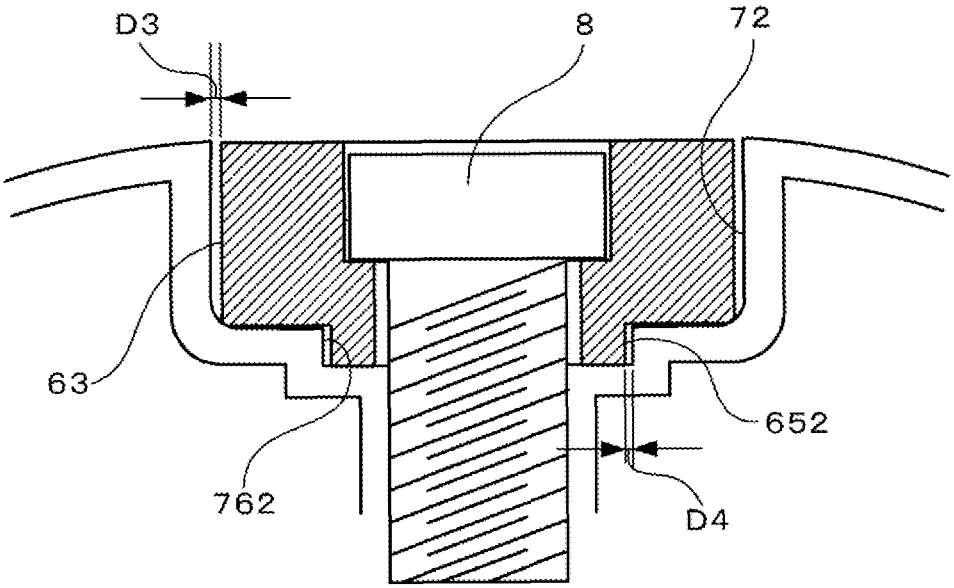
FIG. 19 is a cross-sectional view when the weight member is attached to the recessed portion.

Next, attachment of the weight member 6 will be described. When the weight member 6 is fitted into the recessed portion 7 and the projecting portion 65 is fitted into the receiving portion 76, the shaft portion 82 of the fixing member 8 is inserted into the through hole 64. Then, when the shaft portion 82 is screwed into the fixing hole 74 of the recessed portion 7, the lower surface of the weight member 6 is pressed against the bottom surface 71 of the recessed portion 7, and the weight member 6 is fixed in the recessed portion 7. At this time, the weight member 6 also rotates with the rotation caused by the fixing member 8 being screwed in. The side surface 652 of the projecting portion 65 of the weight member 6 thereby abuts the side wall surface 762 of the receiving portion 76 and is fixed. At this time, the side surface 63 of the weight member 6 does not abut the first side wall surface 72 of the recessed portion 7. Note that a distance D3 between the side surface 63 of the weight member 6 and the first side wall surface 72 at this time is preferably 0.2 to 1.5 mm, in the case where the weight member 6 is disposed such that the distance between both surfaces is the same in all locations (see FIG. 19). Also, a distance D4 between the side surface 652 of the projecting portion 65 and the side wall surface 762 of the receiving portion 76 is preferably 0.2 to 1.0 mm, in the case where the weight member 6 is disposed such that the distance between both surfaces is the same in all locations (see FIG. 19).

2.2.3 Features

Figure 20:
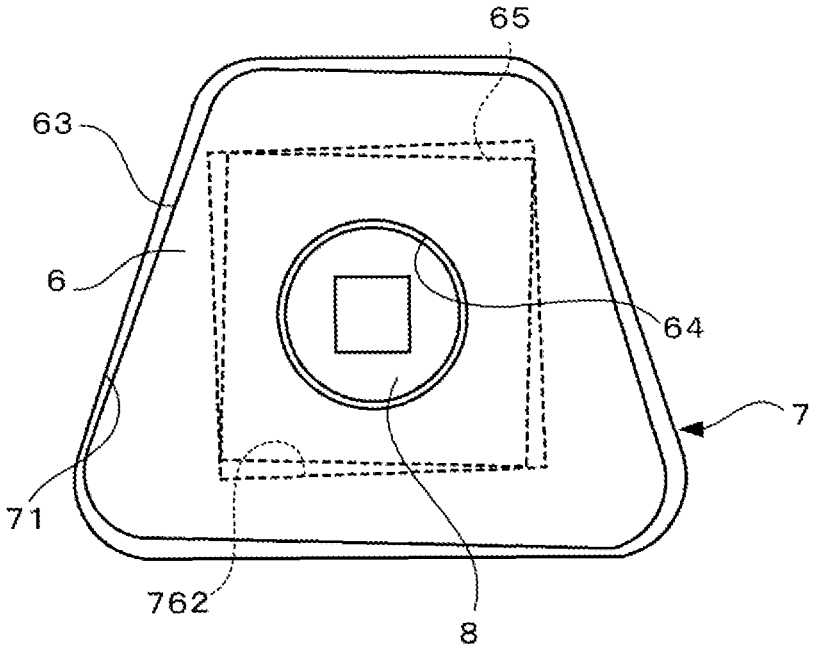
FIG. 20 is a plan view when the weight member is attached to the recessed portion.

As described above, the following effect can be obtained according to the present embodiment. This point will be described with reference to FIG. 20. As shown in the diagram, when the weight member 6 is attached to the recessed portion 7 and the rotation of the fixing member 8 results in the weight member 6 also rotating, the side surface 652 of the projecting portion 65 abuts the side wall surface 762 of the receiving portion 76, before the side surface 63 of the weight member 6 abuts the first side wall surface 72. Thus, a gap still remains between the side surface 63 of the weight member 6 and the first side wall surface 72. Accordingly, even if the rotation position of the weight member 6 is displaced, the displacement of the rotation position of the weight member 6 is no longer readily noticeable, due to the gap between the side surface 63 of the weight member 6 and the first side wall surface 72, and, as a result, degradation in appearance can be prevented.

Figure 21:
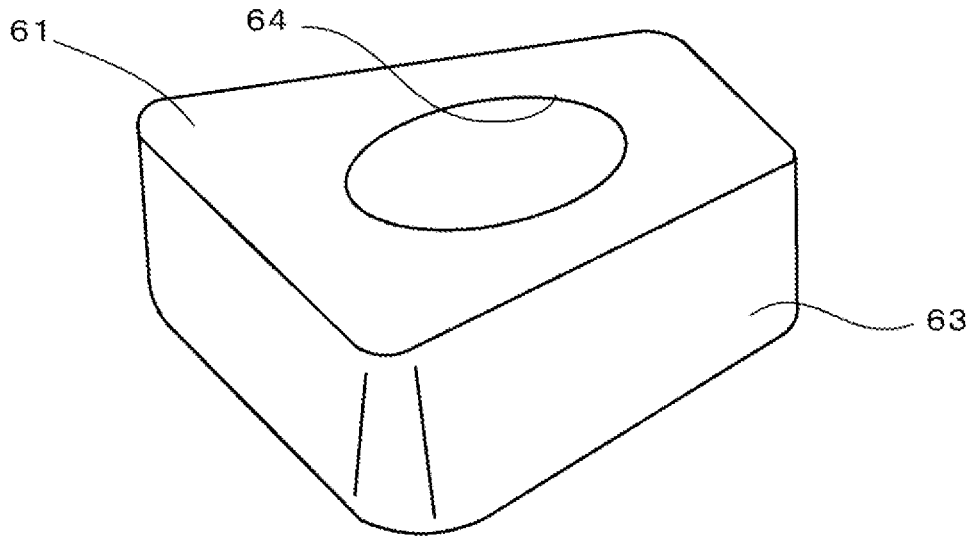
FIG. 21 is a perspective view seen from an upper surface side of the weight member according to the third embodiment.
Figure 22:
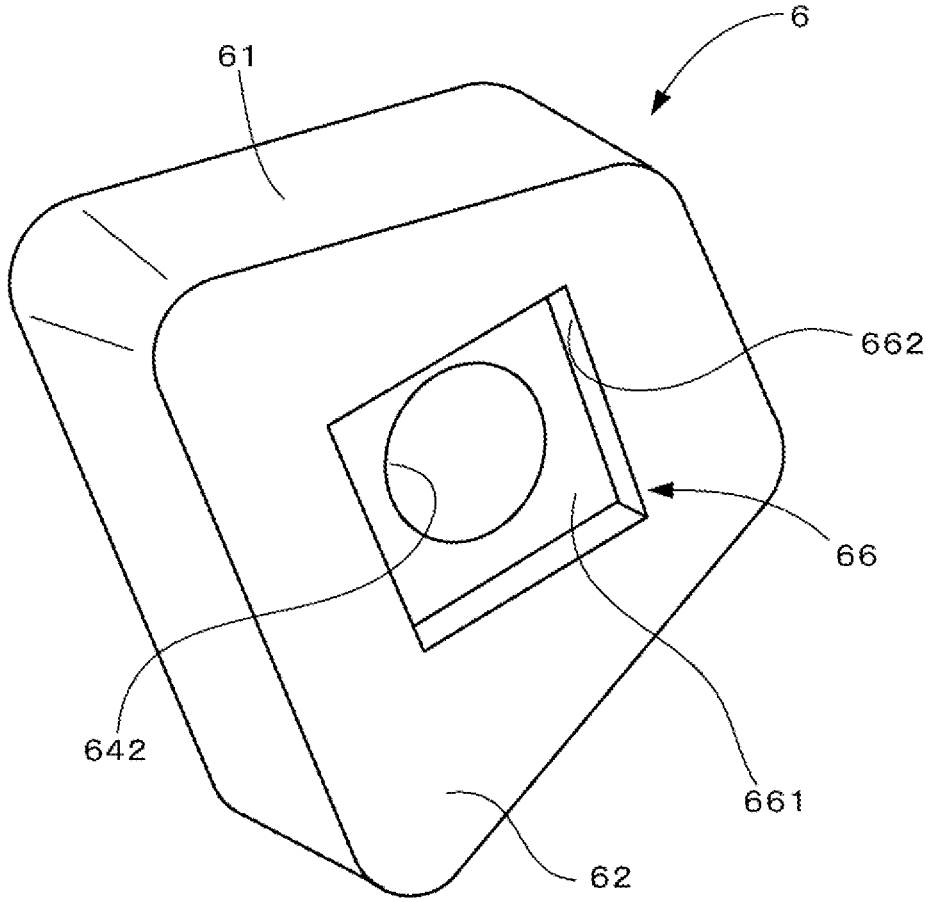
FIG. 22 is a perspective view seen from a lower surface side of the weight member of FIG. 21.
Figure 23:
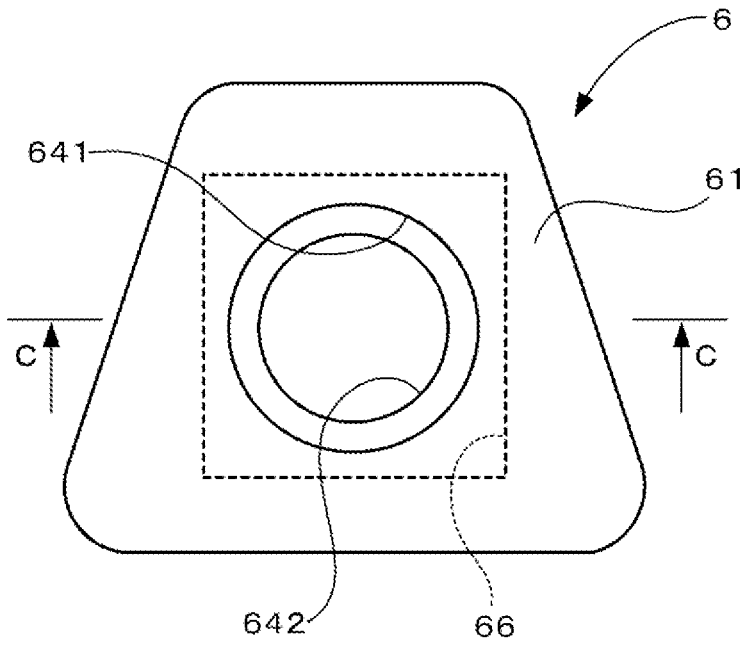
FIG. 23 is a plan view of FIG. 21.
Figure 24:
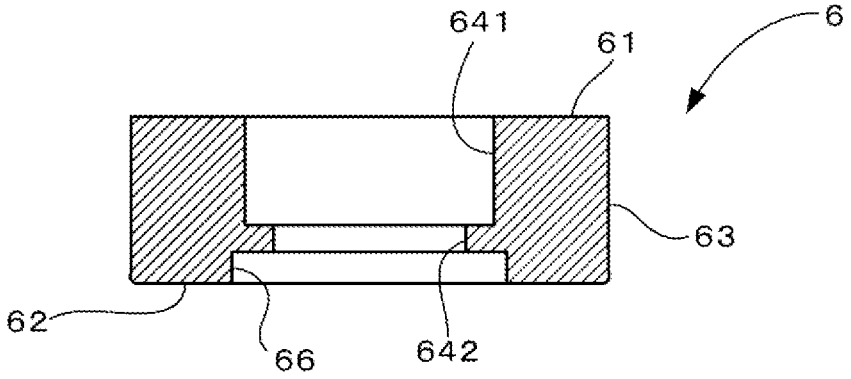
FIG. 24 is a cross-sectional view along a line C-C in FIG. 23.

2.3 Third Embodiment 2.3.1 Configurations of Weight Member and Recessed Portion FIG. 21 is a perspective view seen from the upper surface side of the weight member according to the third embodiment, FIG. 22 is a perspective view seen from the lower surface side of the weight member of FIG. 21, FIG. 23 is a plan view of FIG. 21, and FIG. 24 is a cross-sectional view along a line C-C in FIG. 23. As shown in FIGS. 21 to 24, the weight member 6 according to the third embodiment has a generally similar form to the weight member of the first embodiment, but differs in that a recessed receiving portion 66 is formed in the lower surface. The configuration of the bottom surface of the recessed portion also differs from the first embodiment. This recessed receiving portion 66 and the bottom surface of the recessed portion 7 will be described in detail below, with the same reference signs being given to configuration that is the same as the first embodiment and description thereof being omitted.

As shown in FIGS. 21 to 24, the receiving portion 66 is formed by a rectangular parallelepiped space provided with a bottom surface 661 that is rectangular in plan view and a side wall surface 662 that extends from a periphery of this bottom surface 661 and is connected to the lower surface 62 of the weight member 6. The through hole 64 of the weight member 6 is smaller than the bottom surface 661 of the receiving portion 66, and passes through in a vicinity of the center of the receiving portion 66.

Figure 25:
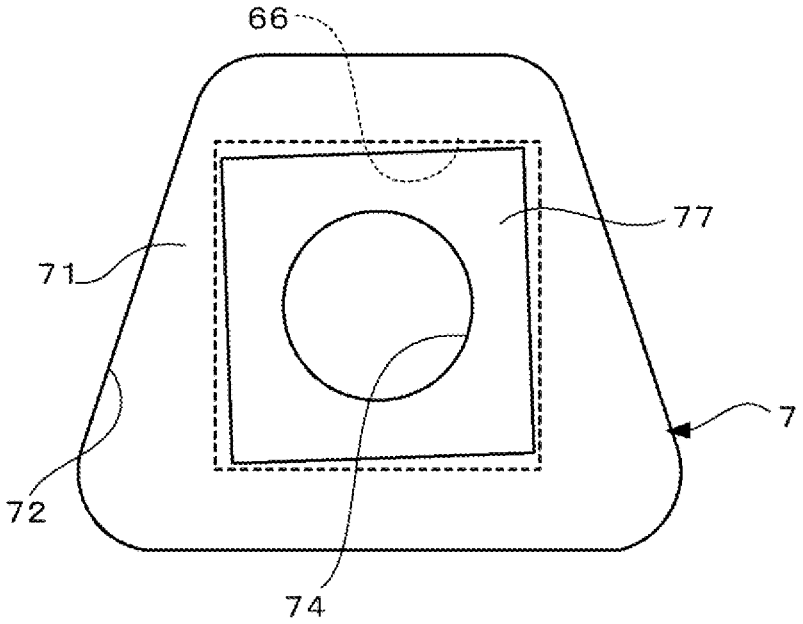
FIG. 25 is a plan view of the recessed portion according to a third embodiment.
Figure 26:
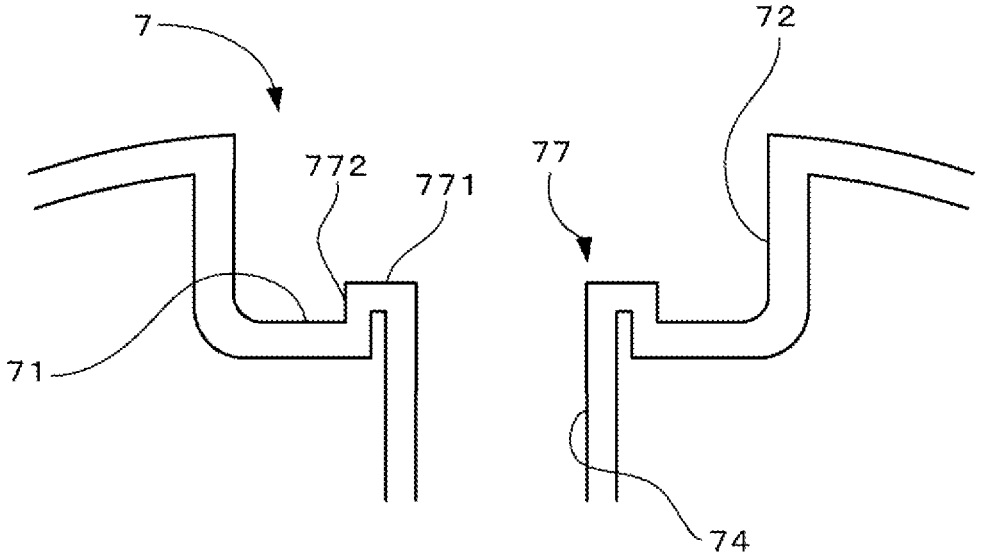
FIG. 26 is a cross-sectional view of FIG. 25.

Next, the recessed portion will be described with reference to FIGS. 25 and 26. FIG. 25 is a plan view of the recessed portion, and FIG. 26 is a cross-sectional view of FIG. 25. As shown in FIGS. 25 and 26, in the present embodiment, a projecting portion 77 onto which the receiving portion 66 of the weight member 6 fits is formed on the bottom surface 71 of the recessed portion 7. The projecting portion 77 has an upper surface 771 that has a rectangular shape in plan view and a side surface 772 that extends from this upper surface 771 and is connected to the bottom surface 71 of the recessed portion 7. Also, a fixing hole 74 into which the shaft portion 82 of the fixing member 8 is screwed is formed in the upper surface 771 of this projecting portion 77.

Also, as shown in FIG. 25, this projecting portion 77 corresponds to the receiving portion 66 of the weight member 6, and when the side surface 63 of the weight member 6 is disposed so as to be the same distance from the first side wall surface 72 in all locations, the projecting portion 77 is disposed in a position, centered on the fixing hole 74, rotated slightly counterclockwise from the receiving portion 66. Note that this rotation angle needs to be smaller than the rotation angle at which the side surface 63 of the weight member abuts the first side wall surface 72, from an attachment position at which the distance between the side surface 63 of the weight member 6 and the first side wall surface 72 is the same in all locations.

2.3.2 Attachment of Weight Member

Figure 27:
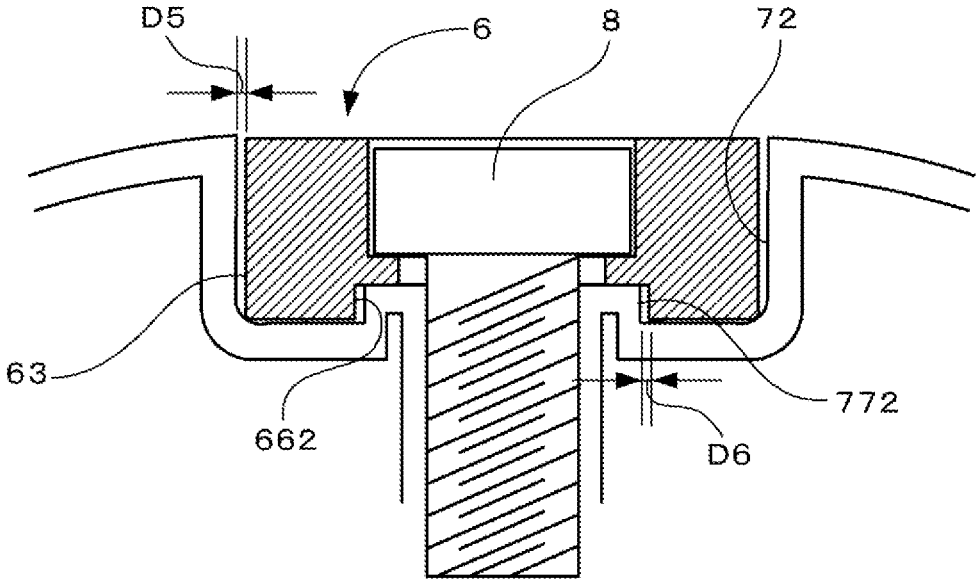
FIG. 27 is a cross-sectional view when the weight member is attached to the recessed portion.

Next, attachment of the weight member 6 will be described. When the weight member 6 is fitted into the recessed portion 7 and the projecting portion 77 is fitted into the receiving portion 66, the shaft portion 82 of the fixing member 8 is inserted into the through hole 64. Then, when the shaft portion 82 is screwed into the fixing hole 74 of the recessed portion 7, the lower surface of the weight member 6 is pressed against the bottom surface 71 of the recessed portion 7, and the weight member 6 is fixed in the recessed portion 7. At this time, the weight member 6 also rotates with the rotation caused by the fixing member 8 being screwed in. The side surface 772 of the projecting portion 77 of the recessed portion 7 thereby abuts the side wall surface 662 of the receiving portion 66 and is fixed. At this time, the side surface 63 of the weight member 6 does not abut the first side wall surface 72 of the recessed portion 7. Note that a distance D5 between the side surface 63 of the weight member 6 and the first side wall surface 72 at this time is preferably 0.2 to 1.5 mm, in the case where the weight member 6 is disposed such that the distance between both surfaces is the same in all locations (see FIG. 27). Also, a distance D6 between the side surface 772 of the projecting portion 77 and the side wall surface 662 of the receiving portion 66 is preferably 0.2 to 1.0 mm, in the case where the weight member 6 is disposed such that the distance between both surfaces is the same in all locations (see FIG. 27).

2.3.3 Features

Figure 28:
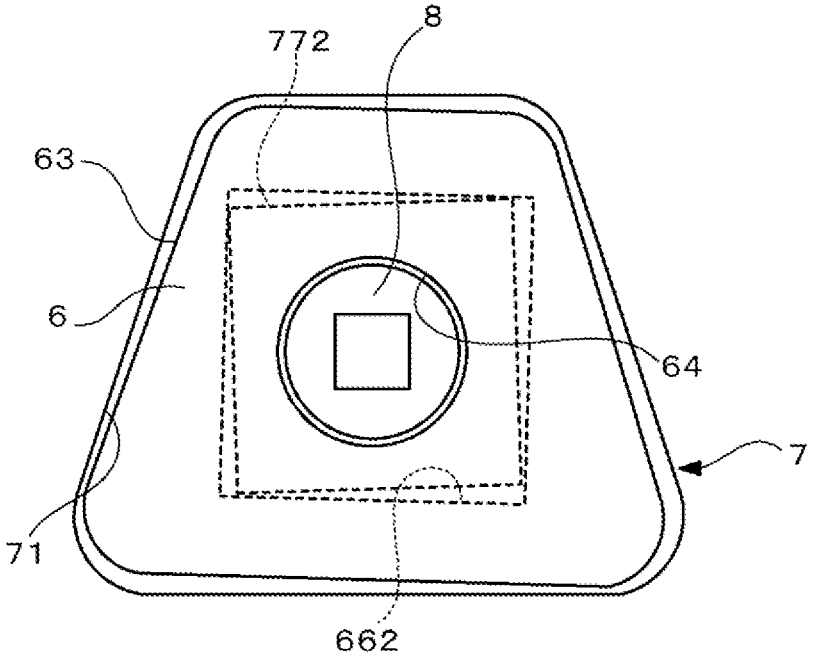
FIG. 28 is a plan view when the weight member is attached to the recessed portion.

As described above, the following effect can be obtained according to the present embodiment. This point will be described with reference to FIG. 28. As shown in the diagram, when the weight member 6 is attached to the recessed portion 7 and the rotation of the fixing member 8 results in the weight member 6 also rotating, the side wall surface 662 of the receiving portion 66 abuts the side surface 772 of the projecting portion 77, before the side surface 63 of the weight member 6 abuts the first side wall surface 72. Thus, a gap still remains between the side surface 63 of the weight member 6 and the first side wall surface 72. Accordingly, even if the rotation position of the weight member 6 is displaced, this displacement is no longer readily noticeable, due to the gap between the side surface 63 of the weight member 6 and the first side wall surface 72, and, as a result, degradation in appearance can be prevented.

3. Variations

Although embodiments of the present invention have been described above, the present invention is not limited to the foregoing embodiment, and various modifications that do not depart from the gist of the invention can be made. Note that the following variations can be combined as appropriate.

3.1

In the first embodiment, the first side wall surface 72 and the second side wall surface 73 are similar in shape, and rotate centered on the fixing hole 74, such that the first side wall surface 72 is inscribed in the second side wall surface 73 in plan view, but the rotation angle of the second side wall surface 73 need only be any rotation angle up to a rotation position at which the first side wall surface 72 is inscribed as described above, from a rotation position at which the distance between the first side wall surface 72 and the second side wall surface 73 is the same in all locations.

Also, other modes are also possible. That is, although, in the first embodiment, the second side wall surface 73 is formed to have a similar shape to the first side wall surface 72, the present invention is not limited thereto. That is, the second side wall surface 73 need not necessarily be formed to have a similar shape, as long as the second side wall surface 73 is formed along the outer side of the first side wall surface 72, and has a larger outer diameter than the first side wall surface 72. A gap can thereby be formed between the side surface 63 of the weight member 6 and the second side wall surface 73.

3.2

In the second embodiment, a configuration is adopted in which corner portions of the side surface 652 of the projecting portion 65 of the weight member 6 abut the side wall surface 762 of the receiving portion 76 of the recessed portion 7, but any part of the side surface 652 of the projecting portion 65 need only abut the side wall surface 762. Accordingly, a configuration may be adopted in which, for example, raised portions are formed on the side surface 652 of the projecting portion 65, and these raised portions abut the side wall surface 762 of the receiving portion 76. Also, the projecting portion 65 and the receiving portion 76 need not necessarily be a polygonal shape in plan view, and need only be configured such that any part of the side surface of the projecting portion 65 abuts the side wall surface of the receiving portion 76, before the side surface 63 of the weight member 6 abuts the first side wall surface 72.

Similarly, in the third embodiment, any part of the side surface 772 of the projecting portion 77 need only abut the side wall surface 662 of the receiving portion 66. Accordingly, a configuration may be adopted in which, for example, raised portions are formed in the side surface 772 of the projecting portion 77, and these raised portions abut the side wall surface 662 of the receiving portion 66. Also, the projecting portion 77 and the receiving portion 66 need not necessarily be a polygonal shape in plan view, and need only be configured such that any part of the side surface of the projecting portion 77 abuts the side wall surface of the receiving portion 66, before the side surface 63 of the weight member 6 abuts the first side wall surface 72.

3.3

In the first to third embodiments, the shape of the weight member 6 in plan view is not particularly limited, and need only be polygonal in plan view. For example, the weight member may have a triangular shape, a pentagonal shape or the like, and may have an inequilateral polygonal shape apart from a regular polygonal shape. Similarly, the shapes of the recessed portion 7, the projecting portions 65 and 77 and the receiving portions 76 and 66 in plan view can also be similarly configured. Also, the method of attachment to the sole portion 3 is not particularly limited, and methods other than screwing can be employed as long as the weight member can be detachably fixed.

3.4

The weight member according to each of the above embodiments may be provided in plurality. That is, a plurality of recessed portions 7 can also be formed in the sole portion 3, and the weight member 6 according to each of the above embodiments can be attached thereto. At least one recessed portion 7 can also be formed in the side portion 4 or the crown portion 2 rather than only the sole portion 3, and the weight member 6 can be attached thereto.

3.5

In each of the above embodiments, the fixing member 8 and the weight member 6 are provided separately, but can also be provided integrally. That is, the fixing member 8 may be rotatably supported inside the through hole 64 of the weight member 6. For example, a configuration may be adopted in which the outer peripheral surface of the head portion 81 of the fixing member 8 and the large diameter portion 641 of the through hole 64 of the weight member 6 are connected with a bearing, and the head portion 81 of the fixing member 8 rotates within the through hole 64.

3.6

In the above embodiments, a wood-type golf club was described, but the golf club according to the present invention is not limited thereto, and may, for example, be any golf club having a hollow head including so-called utility-type clubs and hybrid-type clubs.

REFERENCE SIGNS LIST

1 Face portion
2 Crown portion
3 Sole portion
6 Weight member
65 Projecting portion
66 Receiving portion
7 Recessed portion
76 Receiving portion
77 Projecting portion

The invention claimed is:

1. A golf club head comprising:
a crown portion;
a face portion;
a sole portion;
at least one recessed portion formed in one of the crown portion and the sole portion;
at least one weight member configured to be attached to the recessed portion; and
a fixing member for fixing the weight member to the recessed portion,
wherein the weight member is provided with a main body portion having an upper surface, a lower surface and a side surface, the upper surface and the lower surface being formed to have a polygonal shape in plan view, and a projecting portion projecting from the lower surface of the main body, and a through hole for the fixing member to pass through is provided in the main body portion and the projecting portion, the projecting portion has a lower surface and a side surface that is continuous with the lower surface and connected to the lower surface of the main body portion, the recessed portion is provided with a bottom surface and a side wall surface that is continuous with the bottom surface, a recessed receiving portion into which the projecting portion of the weight member fits is formed in the bottom surface of the recessed portion, the receiving portion is provided with a bottom surface in which a fixing hole in which the fixing member is to be fixed is formed, and a side wall surface that is continuous with the bottom surface, and the golf club head is configured such that a gap is formed between the side surface of the main body portion of the weight member and the side wall surface of the recessed portion, when the projecting portion of the weight member rotates within the receiving portion centered on the fixing hole and the side surface of the projecting portion abuts the side wall surface of the receiving portion.

2. A golf club head according to claim 1, wherein the through hole of the weight member is provided with a large diameter portion that has a circular shape in plan view and is open in the upper surface, and a small diameter portion that has a circular shape in plan view and is open from a bottom surface of the large diameter portion to the lower surface of the projecting portion.

3. A golf club head according to claim 2, wherein the fixing member is provided with a head portion being housed in the large diameter portion and a shaft portion extending from the head portion and being inserted into the small diameter portion.

4. The golf club head according to claim 1, wherein the side surface of the projecting portion is formed to have a rectangular shape in plan view, and the side wall surface of the receiving portion is formed to have a rectangular shape in plan view, so as to correspond to the side surface of the projecting portion.

* * * * *